US006845791B2

(12) United States Patent
Schneider et al.

(10) Patent No.: US 6,845,791 B2
(45) Date of Patent: Jan. 25, 2005

(54) COMPOSITE PREPREG MATERIAL FORM WITH IMPROVED RESISTANCE TO CORE CRUSH AND POROSITY

(75) Inventors: Terry L. Schneider, Puyallup, WA (US); Terence L. Pelton, Graham, WA (US)

(73) Assignee: The Boeing Company, Seattle, WA (US)

( * ) Notice: Subject to any disclaimer, the term of this patent is extended or adjusted under 35 U.S.C. 154(b) by 77 days.

(21) Appl. No.: 10/232,008

(22) Filed: Aug. 29, 2002

(65) Prior Publication Data

US 2003/0036325 A1 Feb. 20, 2003

Related U.S. Application Data

(63) Continuation of application No. 09/406,199, filed on Sep. 27, 1999

(60) Provisional application No. 60/105,028, filed on Oct. 20, 1998.

(51) Int. Cl.[7] ..... D03D 15/00

(52) U.S. Cl. ..... 139/426 TW; 139/420 A; 442/189

(58) Field of Search ..... 139/426 TW, 420 A; 442/189

(56) References Cited

U.S. PATENT DOCUMENTS

| | | | | |
|---|---|---|---|---|
| 1,392,535 A | | 10/1921 | Stevenson | |
| 3,250,662 A | | 5/1966 | Seaman | |
| 3,926,228 A | * | 12/1975 | Burns et al. | 139/420 R |
| 3,993,829 A | * | 11/1976 | Park | 442/21 |
| 4,615,256 A | | 10/1986 | Fukuta et al. | |
| 4,714,642 A | | 12/1987 | McAliley et al. | |
| 4,781,223 A | * | 11/1988 | McAliley et al. | 139/420 R |
| 4,927,698 A | | 5/1990 | Jaco et al. | |
| 5,104,726 A | | 4/1992 | Ross | |
| 5,236,775 A | * | 8/1993 | Swoboda et al. | 428/219 |
| 5,244,718 A | * | 9/1993 | Taylor et al. | 442/208 |
| 5,286,553 A | | 2/1994 | Haraguchi et al. | |
| 5,447,787 A | | 9/1995 | Shaffer | |
| 5,454,403 A | | 10/1995 | Kerr et al. | |
| 5,466,514 A | * | 11/1995 | Kataoka et al. | 442/81 |
| 5,538,781 A | * | 7/1996 | Rao et al. | 442/217 |
| 5,540,980 A | | 7/1996 | Tolbert et al. | |
| 5,732,748 A | | 3/1998 | Aucagne et al. | |

(List continued on next page.)

FOREIGN PATENT DOCUMENTS

| | | |
|---|---|---|
| FR | 2 698 640 | 6/1994 |

*Primary Examiner*—John J. Calvert
*Assistant Examiner*—Robert H. Muromoto, Jr.
(74) *Attorney, Agent, or Firm*—Christensen O'Connor Johnson Kindness PLLC

(57) ABSTRACT

A composite prepreg material (10) with improved resistance to core crush and porosity incorporates a plurality of different fiber forms having varying cross-sectional configurations. Preferably, the fibers are interwoven in a warp (14) and fill (18) perpendicular orientation pattern. The varying cross-sectional configurations of the different fiber forms causes the fiber forms to have different levels of spreadability and frictional resistance to movement of the fiber. The present invention overcomes the susceptibility to many defects (specifically core crush and porosity) associated with composite material of a single fiber form having a set cross-sectional configuration, by incorporating multiple fiber forms having varying cross-sectional configurations. This multi-fiber form incorporation allows the strengths of one fiber form's properties to help compensate for the weaknesses of another fiber form's properties, and vice versa. Many variations of multi-fiber form woven designs can be utilized that incorporate fiber forms such as ST (standard twist tows); UT (untwisted tows, i.e. previously twisted and then untwisted tows); and NT (never twisted tows).

14 Claims, 4 Drawing Sheets

U.S. PATENT DOCUMENTS 5,783,278 A 7/1998 Nishimura et al.
5,791,384 A 8/1998 Evans
5,792,713 A * 8/1998 Scari et al. ..... 442/189
5,939,338 A 8/1999 Aucagne et al.
6,261,675 B1 7/2001 Hsiao et al.
6,523,578 B1 * 2/2003 Schneider et al. ... 139/426 TW

* cited by examiner

COMPOSITE PREPREG MATERIAL FORM WITH IMPROVED RESISTANCE TO CORE CRUSH AND POROSITY

CROSS-REFERENCE TO RELATED APPLICATIONS

This application is a continuation of co-pending application Ser. No. 09/406,199, filed Sep. 27, 1999, priority from the filing date of which is hereby claimed under 35 U.S.C. § 120. application Ser. No. 09/406,199 claims the benefit of U.S. Provisional Application No. 60/105,028, filed Oct. 20, 1998, the benefit of which is claimed under 35 U.S.C. § 119.

FIELD OF THE INVENTION

The present invention relates to a composite prepreg or woven material, and more particularly, to a composite material with improved resistance to core crush and porosity.

BACKGROUND OF THE INVENTION

Structural composite parts of aircraft designed with honeycomb core for stiffening and joggled flanges (such as ribs, spars, elevators, rudders, flaps, etc.) frequently experience producibility problems associated with these two design elements. Honeycomb core in composite parts can experience "core crush" which is a non-repairable defect that occurs when honeycomb core sections collapse. Core crush is thought to be related to the properties of the prepreg and woven composite materials. Composite prepreg materials contain a fiber reinforcement form (usually tape or fabric) that has been preimpregnated with a liquid resin and thermally advanced to a viscous stage. Composite woven materials contain interlaced yarns or fibers, usually in a planar structure, that establish a weave pattern from the yarns which is used as the fibrous constituent in an advanced composite lamina.

Parts with joggled flanges are also sensitive to porosity in the joggle region due to the inability of the prepreg to stay "seated" against the radius, and the joggle of the tool during lay-up and cure. Porosity is a defect involving unfilled space inside a material that frequently limits the material strength.

These core crush and porosity defects are producibility problems that are currently experienced worldwide. Core crush and porosity are the two predominant types of defects leading to part rejections in prepreg and woven composite materials since these conditions can be rarely be repaired.

Extensive research and development has been performed over the years by composite part fabricators in an effort to solve the core crush producibility problem. Core details and adjacent prepreg plies are stabilized in current production parts by various different methods (ply tie-downs, precured adhesive over the core, etc.) to reduce this core crush problem. Specific stabilization methods are documented in The Boeing Company's composite BAC Process Specifications which are incorporated herein by reference. However, these stabilization methods are unsatisfactory in that they are time consuming and add significant expense to the current production of sandwiched structure parts.

Likewise, extensive research and development has been performed in an attempt to address the porosity producibility problem in joggled parts. Particularly those parts utilizing the Boeing BMS 8-256 prepreg material (as described in the Boeing Materials Specification incorporated herein by reference). The extremely low flow properties of this prepreg's resin have particularly exacerbated the problem of porosity in parts designed with joggles. The BMS 8-256 prepreg material is currently one of the most widely used prepreg materials for composite secondary and primary structures for aircraft. Both material and process improvements have been evaluated in an effort to eliminate porosity. These have included the use of elastomeric pressure pads against the joggle during cure, decreasing part staging time prior to the cure, increasing the tack and drape of the prepreg, etc. These measures have yet to totally and reliably eliminate porosity in the joggles of parts fabricated with a prepreg material having low flow resin properties.

There is a continuing need in the art for a structural composite material designed with a honeycomb core that is resistant to core crush and porosity defects, particularly for a material having high resin viscosity and/or low flow properties.

SUMMARY OF THE INVENTION

The present invention is directed towards a composite material that includes warp yarns and fill yarns. The warp and fill yarns are composed of at least two different kinds of yarn that are selected from the group consisting of standard twist fiber (ST), untwisted fiber (UT), and never twisted fiber (NT). Many different combinations of ST fiber, UT fiber, and NT fiber are possible for utilization in the warp and the fill, as described with greater specificity below.

In a preferred embodiment of the present invention, the warp yarns comprise one of the group consisting of standard twist fiber, untwisted fiber, and never twisted fiber; and the fill yarns comprise a different one of the group consisting of standard twist fiber, untwisted fiber, and never twisted fiber. Thus, in one version of this preferred embodiment, the warp yarns comprise one of the group consisting of standard twist fiber and never twisted fiber, and the fill yarns comprise the other of the group consisting of standard twist fiber and never twisted fiber. In another version of this preferred embodiment, the warp yarns comprise one of the group consisting of untwisted fiber and never twisted fiber, and the fill yarns comprise the other of the group consisting of untwisted fiber and never twisted fiber. In yet another version of this preferred embodiment, the warp yarns comprise one of the group consisting of standard twist fiber and untwisted fiber, and the fill yarns comprise the other of the group consisting of standard twist fiber and untwisted fiber.

In another preferred embodiment of the present invention, a first percentage of the warp yarns comprise one of the group consisting of standard twist fiber, untwisted fiber, and never twisted fiber; and a second percentage of the warp yarns comprise a different one of the group consisting of standard twist fiber, untwisted fiber, and never twisted fiber. Thus, in one version of this preferred embodiment, a first percentage of the warp yarns comprise one of the group consisting of standard twist fiber and never twisted fiber, and a second percentage of the warp yarns comprise the other of the group consisting of standard twist fiber and never twisted fiber. In another version of this preferred embodiment, a first percentage of the warp yarns comprise one of the group consisting of standard twist fiber and untwisted fiber, and a second percentage of the warp yarns comprise the other of the group consisting of standard twist fiber and untwisted fiber. In still another version of this preferred embodiment, a first percentage of the warp yarns comprise one of the group consisting of untwisted fiber and never twisted fiber, and a second percentage of the warp yarns comprise the other of the group consisting of untwisted fiber and never twisted fiber.

In another aspect of a preferred embodiment of the present invention, a first percentage of the fill yarns comprise one of the group consisting of standard twist fiber, untwisted fiber, and never twisted fiber; and a second percentage of the fill yarns comprise a different one of the group consisting of standard twist fiber, untwisted fiber, and never twisted fiber. Thus, in one version of this preferred embodiment, a first percentage of the fill yarns comprise one of the group consisting of standard twist fiber and never twisted fiber, and a second percentage of the fill yarns comprise the other of the group consisting of standard twist fiber and never twisted fiber. In another version of this preferred embodiment, a first percentage of the fill yarns comprise one of the group consisting of untwisted fiber and never twisted fiber, and a second percentage of the fill yarns comprise the other of the group consisting of untwisted fiber and never twisted fiber. In still another version of this preferred embodiment, a first percentage of the fill yarns comprise one of the group consisting of standard twist fiber and untwisted fiber, and a second percentage of the fill yarns comprise the other of the group consisting of standard twist fiber and untwisted fiber.

In still another preferred embodiment of the present invention, the warp yarns comprise two of the group consisting of standard twist fiber, untwisted fiber, and never twisted fiber; and the fill yarns comprise two of the group consisting of standard twist fiber, untwisted fiber, and never twisted fiber. In one version of this preferred embodiment, the warp yarns comprise two of the group consisting of standard twist fiber, untwisted fiber, and never twisted fiber; and the fill yarns comprise the same two of the group consisting of standard twist fiber, untwisted fiber, and never twisted fiber.

In yet another preferred embodiment of the present invention, the warp yarns comprise one of the group consisting of standard twist fiber, untwisted fiber, and never twisted fiber; and the fill yarns comprise the two of the group consisting of standard twist fiber, untwisted fiber, and never twisted fiber. In one version of this preferred embodiment, the warp yarns comprise one of the group consisting of standard twist fiber, untwisted fiber, and never twisted fiber; and the fill yarns comprise the other two of the group consisting of standard twist fiber, untwisted, fiber, and never twisted fiber.

One preferred embodiment of the present invention includes warp yarns that comprise two of the group consisting of standard twist fiber, untwisted fiber, and never twisted fiber; and fill yarns that comprise the one of the group consisting of standard twist fiber, untwisted fiber, and never twisted fiber. A version of this preferred embodiment includes warp yarns that comprise two of the group consisting of standard twist fiber, untwisted fiber, and never twisted fiber, and fill yarns that comprise the other one of the group consisting of standard twist fiber, untwisted fiber, and never twisted fiber.

In an alternate preferred embodiment of the present invention, a first percentage of the warp yarns comprise one of the group consisting of standard twist fiber, untwisted fiber, and never twisted fiber; a second percentage of the warp yarns comprise a different one of the group consisting of standard twist fiber, untwisted fiber, and never twisted fiber; and a third percentage of the warp yarns comprise a remaining one of the group consisting of standard twist fiber, untwisted fiber, and never twisted fiber. In another aspect of this alternate preferred embodiment, a first percentage of the fill yarns comprise one of the group consisting of standard twist fiber, untwisted fiber, and never twisted fiber; a second percentage of the fill yarns comprise a different one of the group consisting of standard twist fiber, untwisted fiber, and never twisted fiber; and a third percentage of the fill yarns comprise a remaining one of the group consisting of standard twist fiber, untwisted fiber, and never twisted fiber.

In another alternate preferred embodiment of the present invention, the warp yarns comprise two of the group consisting of standard twist fiber, untwisted fiber, and never twisted fiber; and the fill yarns comprise all three of the group consisting of standard twist fiber, untwisted fiber, and never twisted fiber. Another preferred embodiment includes warp yarns that comprise all three of the group consisting of standard twist fiber, untwisted fiber, and never twisted fiber; and fill yarns that comprise two of the group consisting of standard twist fiber, untwisted fiber, and never twisted fiber.

In yet another alternate preferred embodiment of the present invention, the warp yarns comprise all three of the group consisting of standard twist fiber, untwisted fiber, and never twisted fiber; and the fill yarns comprise all three of the group consisting of standard twist fiber, untwisted fiber, and never twisted fiber. Preferably, the composite material of the present invention is prepreg composite material, and the fiber of the present invention is carbon fiber. Additionally, the standard twist fiber has a substantially circular cross-section, the never twisted fiber has a substantially elliptical cross-section, and the untwisted fiber has a modified elliptical cross-section.

Another exemplary embodiment of the present invention contains multi-directional fibers having at least first and second directional configurations of interlaced material, which in turn include at least two different kinds of yarn selected from the group consisting of standard twist fiber, untwisted fiber, and never twisted fiber. An additional exemplary embodiment of the present invention contains a material of warp fiber tows and fill fiber tows. The warp and fill tows include at least two different kinds of fiber, the first of the at least two different kinds of fiber having an approximately circular cross-section, a lower degree of spreadability, and a higher degree of frictional resistance, the second of the at least two different kinds of fiber having an approximately elliptical cross-section, a higher degree of spreadability, and a lower degree of frictional resistance. The combination of at least two different kinds of yarn selected from the group facilitates reducing the frequency of porosity and core crush defects.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
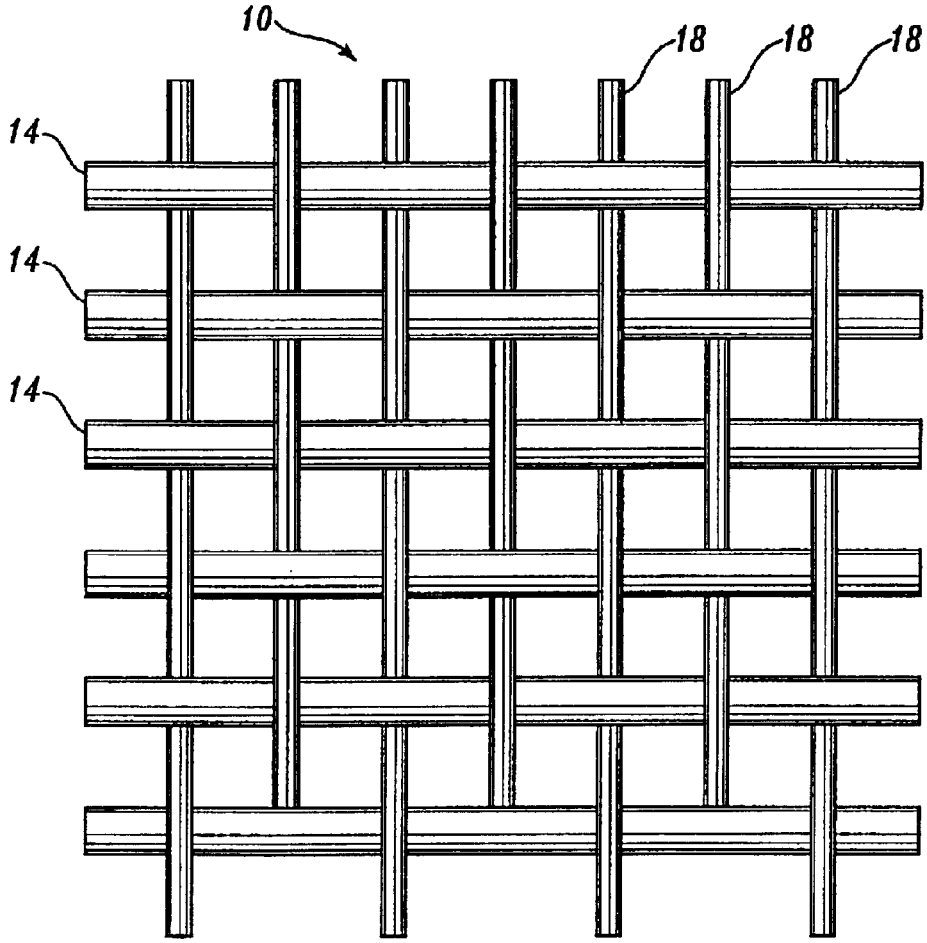
FIG. 1 illustrates a preferred embodiment of the present invention that incorporates fill yarn of a standard twist (ST) fiber form and warp yarn of a never twisted (NT) fiber form.

FIG. 1 illustrates a preferred embodiment of a composite prepreg material 10 with improved resistance to core crush and porosity, constructed in accordance with the present invention that incorporates a plurality of different fiber forms having varying cross-sectional configurations. Preferably, the fibers are interwoven in a warp and fill perpendicular orientation pattern. The varying cross-sectional configurations of the different fiber forms causes the fiber forms to have different levels of spreadability which determine the degree of openness of the weave structure, and ultimately the frictional resistance to movement of the prepreg itself. The present invention overcomes the susceptibility to many defects (specifically core crush and porosity) associated with composite material of a single fiber form having a set cross-sectional configuration, by incorporating multiple fiber forms having varying cross-sectional configurations. This multi-fiber form incorporation allows the strengths of one fiber form's properties to help compensate for the weaknesses of another fiber form's properties, and vice versa. Many variations of multi-fiber form woven designs can be utilized without departing from the scope of the present invention, as are described in greater detail below.

Figure 4:
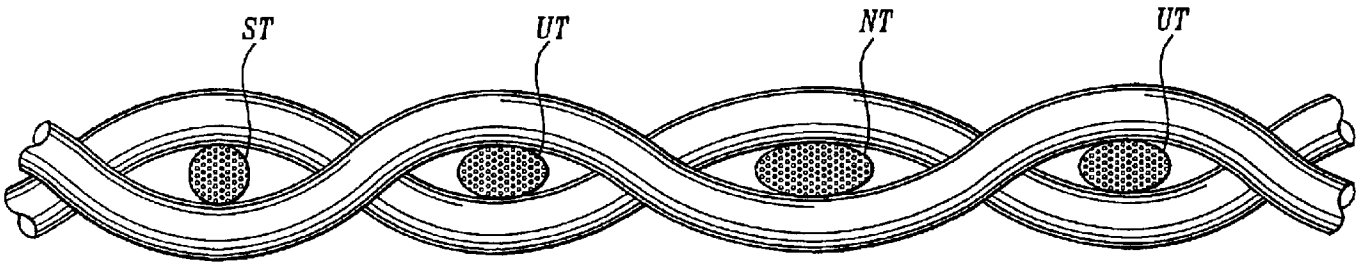
FIG. 4 illustrates a cross-sectional view of the preferred embodiment of FIG. 3.
Figure 5:
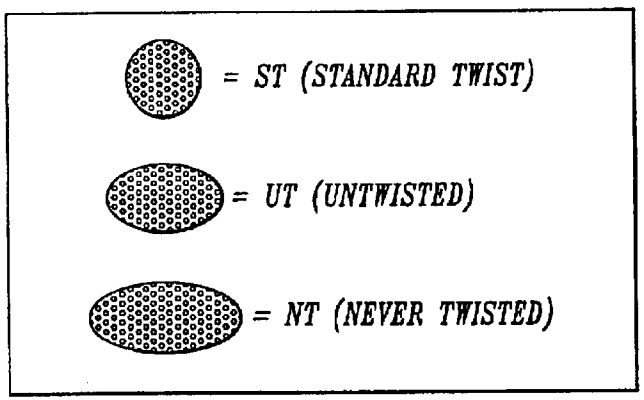
FIG. 5 illustrates a cross-sectional view of the three fiber forms, standard twist (ST), never twisted (NT), and untwisted (UT) used in the preferred embodiment of FIG. 3.

Carbon fiber, preferably T300 fiber (T300 fiber specification description incorporated herein by reference), is used to produce plain weave fabric (preferably 3K-70-PW, specification description incorporated herein by reference) for prepreg material (preferably BMS 8-256, specification description incorporated herein by reference), and is qualified under BMS 9-8 (Boeing Materials Specification BMS 9-8 incorporated herein by reference). The T300 carbon fiber is available in three different qualified forms: (1) T300 ST (standard twist tows); (2) T300 UT (untwisted tows, i.e. previously twisted and then untwisted tows); and (3) T300 NT (never twisted tows). Standard twist tows (ST) are substantially circular in cross section and are typically described as being "rope-like," as shown in FIGS. 4 and 5. Never twisted tows (NT) have a substantially flattened elliptical-type cross section and are generally described as being "ribbon-like" (also shown in FIGS. 4 and 5). Untwisted tows (UT) have a cross section of a configuration somewhere in between ST fiber and NT fiber, i.e., still elliptical in cross section, but more circular and less flattened than the NT fiber (also shown in FIGS. 4 and 5). In another preferred embodiment, glass fiber is utilized instead of, or in addition to carbon fiber.

Referring again to FIG. 1, a preferred embodiment of the present invention resolves both core crush and porosity producibility problems in a single prepreg material (woven fabric form) by incorporating both T300 ST and T300 NT fiber forms into the weave of the fabric. A number of preferred embodiments exist that incorporate various combinations of the two fiber forms in a single plain weave fabric. In the exemplary embodiment 10 of the present invention illustrated in FIG. 1, all warp yarns 14 are of one fiber form (NT in this embodiment) and all fill yarns 18 are of another fiber form (ST in this embodiment). Warp yarns are defined as yarns of a woven fabric that run in the longitudinal direction of the fabric. Fill yarns are defined as yarns of a woven fabric that are oriented at right angles to the warp in the fabric. In an alternate preferred embodiment of the present invention all warp yarns could be of the ST fiber form and all fill yarns could be of the NT fiber form.

Further, various ratios of the total yarn counts in each direction (warp and fill) could contain combinations of mixed fiber form. Examples of these ratios are shown in Table 1 below:

TABLE 1

| Fabric With ST and NT Fiber Forms | |
|---|---|
| Warp Yarns: | a ratio of X % ST fiber form with a corresponding 100 − X % NT fiber form. |
| Fill Yarns: | a ratio of Y % ST fiber form with a corresponding 100 − Y % NT fiber form. |

Figure 2:
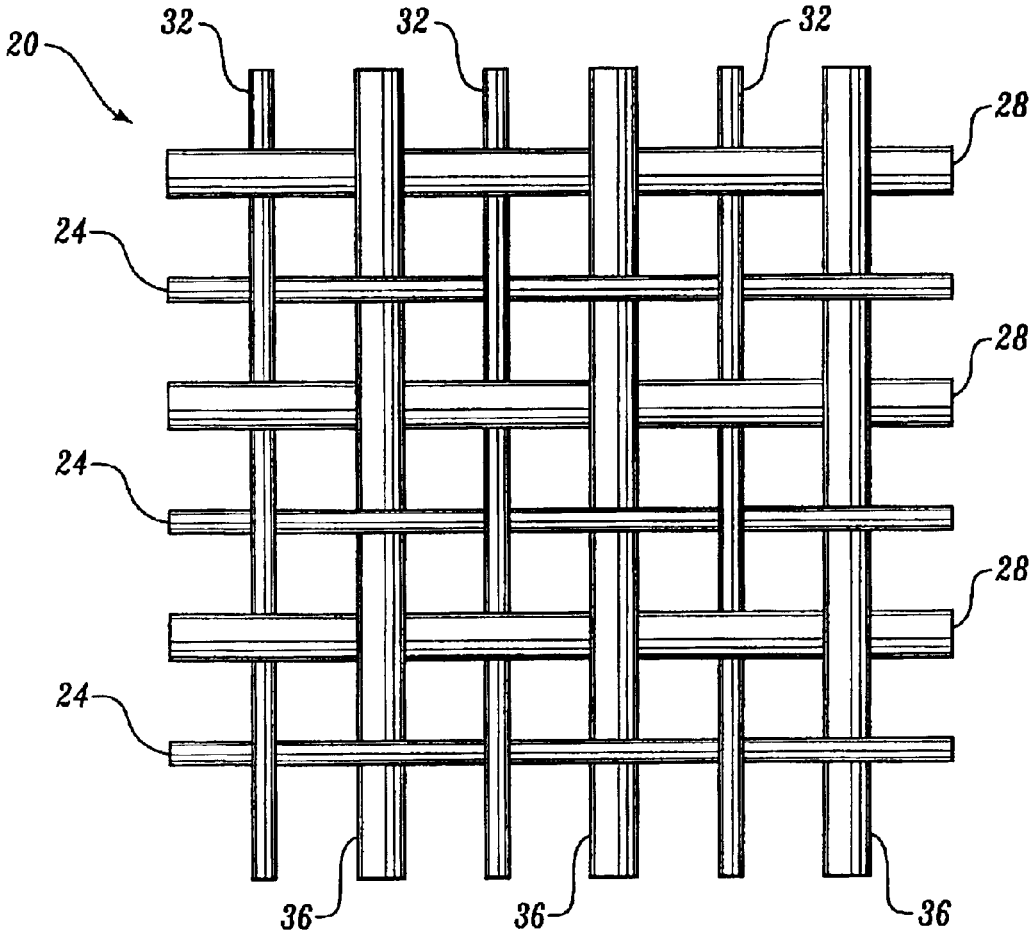
FIG. 2 illustrates a preferred embodiment of the present invention that incorporates a fill total yarn count ratio of 50 percent standard twist (ST) fiber form and 50 percent never twisted (NT) fiber form, and warp total yarn count ratio of 50 percent standard twist (ST) fiber form and 50 percent never twisted (NT) fiber form.
Figure 3:
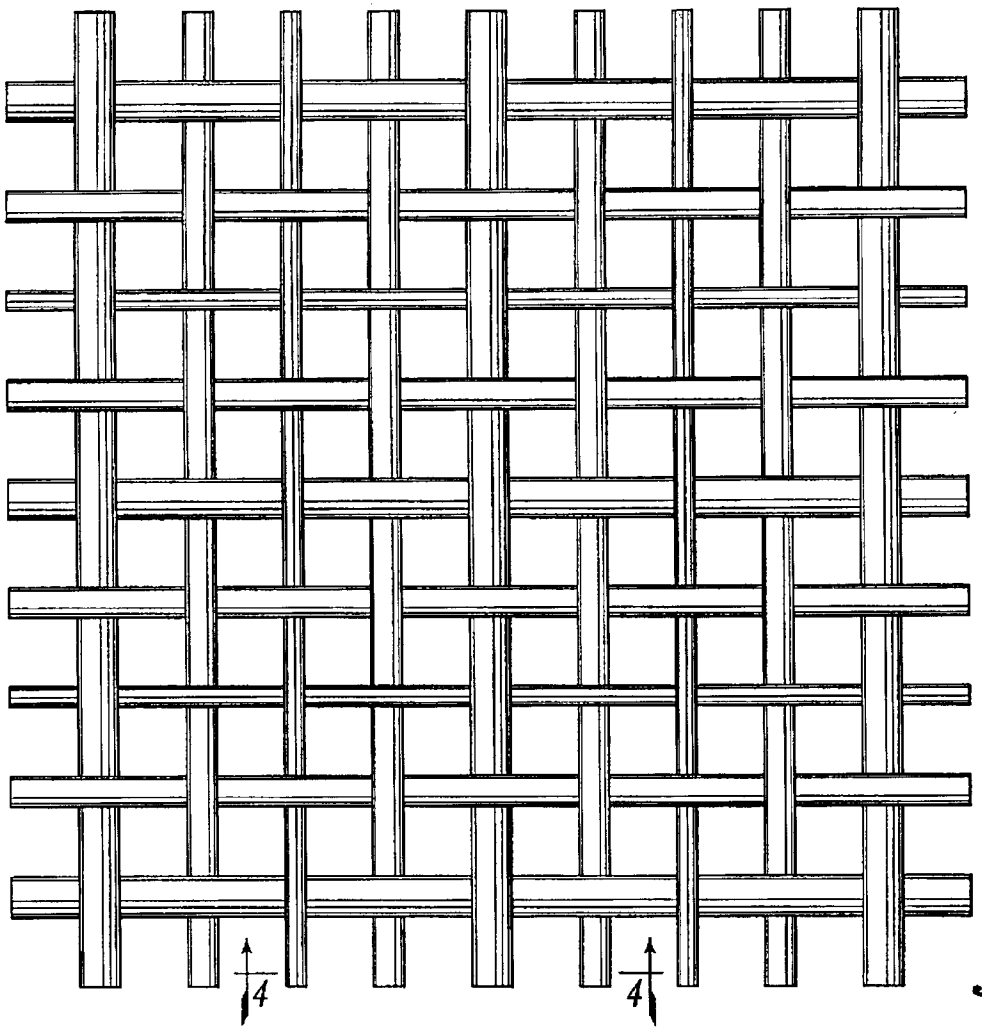
FIG. 3 illustrates a preferred embodiment of the present invention that incorporates a fill total yarn count ratio of 33.3 percent standard twist (ST) fiber form, 33.3 percent never twisted (NT) fiber form, and 33.3 percent untwisted (UT) fiber form; and warp total yarn count ratio of 33.3 percent standard twist (ST) fiber form, 33.3 percent never twisted (NT) fiber form, and 33.3 percent untwisted (UT) fiber form.

FIG. 2 illustrates an embodiment 20 of the present invention that falls within the ratio of parameters outlined in Table 1. Specifically, in this embodiment 20, 50% of the warp yarns are ST fiber form warp 24 and the remaining 50% of the warp yarns are in NT fiber form warp 28. Additionally, in the same embodiment, 50% of the fill yarns are ST fiber form fill 32 and the remaining 50% of the fill yarns are NT fiber form fill 36.

Similarly, other total yarn count ratio variations are utilized for alternate preferred embodiments of the present invention incorporating UT and ST combinations, as well as UT and NT combinations. Ratio descriptions of these embodiments are included in Tables 2 and 3 as shown below:

TABLE 2

| Fabric With ST and UT Fiber Forms | |
|---|---|
| Warp Yarns: | a ratio of X % ST fiber form with a corresponding 100 − X % UT fiber form. |
| Fill Yarns: | a ratio of Y % ST fiber form with a corresponding 100 − Y % UT fiber form. |

TABLE 3

| Fabric With UT and NT Fiber Forms | |
|---|---|
| Warp Yarns: | a ratio of X % UT fiber form with a corresponding 100 − X % NT fiber form. |
| Fill Yarns: | a ratio of Y % UT fiber form with a corresponding 100 − Y % NT fiber form. |

Further preferred embodiments of the present invention utilize combinations of all three fiber forms (ST, UT, and NT). One embodiment incorporating all three fiber forms uses one fiber form (either ST, UT, or NT) in one direction (either warp or fill), and uses a combination of either the remaining two fiber forms or all three fiber forms in the other direction (the other of fill or warp). Illustrative exemplary embodiments of this composition include: (1) Warp yarn—100% UT fiber; Fill yarn—50% ST fiber, 50% NT fiber; and (2) Warp yarn—100% ST fiber; Fill yarn—40% UT fiber, 40% NT fiber, 20% ST fiber. Another preferred embodiment incorporating all three fiber forms, uses two fiber forms in one direction, and a combination of all three fiber forms in the other direction. An exemplary embodiment of this composition is as follows: Warp yarn—50% ST fiber, 50% NT fiber; Fill yarn—40% ST fiber, 40% NT fiber, 20% UT fiber. Still other embodiments of the present invention utilizing three fiber forms have total yarn counts including percentages of all three fiber forms running in both directions (fill and warp). An illustrative exemplary embodiment of this type is as follows: Warp yarn—33.3% ST fiber, 33.3% NT fiber, 33.3% UT fiber; Fill yarn—33.3% ST fiber, 33.3% NT fiber, 33.3% UT fiber.

Additionally, other embodiments of the present invention contain the above fabric materials with varying degrees of percentage openness in the weave structure. Percentage openness is defined as the area of light passing through the fabric relative to the area of light blocked due to the fiber tows. Due to the spreadability differences of each fiber form, ST, UT, and NT, each fiber form has a different, but specific degree of percentage openness in the weave, if processed under the same conditions during resin impregnation and polishing. The percentage openness can also be controlled in the end product of the prepreg material by the impregnation and polishing processing parameters. These features are of particular interest since the percentage openness of a specific fabric contributes to the effectiveness of eliminating porosity and core crush in the final part.

Extensive research and development has been performed investigating core crush and porosity defects, including the testing and collection of extensive production part data in order to clarify the mechanisms involved in core crush and porosity defects in composite parts. A significant amount of this data collection and testing has focused on the BMS 8-256 prepreg material, since parts fabricated with this material have tended to experience the highest degrees of core crush and porosity rejections.

Analysis of the data from testing the production parts has shown a correlation between the T300 fiber form (ST, UT, or NT) and the occurrence of core crush and porosity in the BMS 8-256 plain weave fabric materials. In particular, sandwich structure parts fabricated with T300 NT fiber have a much higher sensitivity to core crush, but a much lower sensitivity to porosity. Conversely, the same parts fabricated with T300 ST fiber have a much lower sensitivity to core crush, but a much higher sensitivity to porosity. These relationships can be related to each fiber form's properties, in particular, the spreadability of the tow (tow is sometimes referred to as yarn) and the tow's frictional resistance to movement when incorporated into a woven product form. These relationships are summarized in Table 4 below:

TABLE 4

T300 Fiber Form Effects

| Fiber Form | Spreadability | Frictional Resistance | Porosity Risk | Core Crush Risk |
|---|---|---|---|---|
| ST | Low | High | High | Low |
| UT | ↓ | ↑ | ↑ | ↓ |
| NT | High | Low | Low | High |

Since composite parts typically contain both features of honeycomb core for stiffening and joggles, only one of these two defect problems (core crush or porosity) can be resolved at a time, when utilizing a single fiber form in the plain weave fabric (which is the current prior art methodology used in composite prepreg material production). Specifically, using T300 ST fiber greatly reduces core crush defects, but results in a higher susceptibility to porosity, while using T300 NT fiber greatly reduces porosity defects, but results in a higher susceptibility to core crush defects. The present invention utilizes a combination of fiber forms to produce a composite material with a balanced resistance to porosity and core crush defects.

Core crush and internal porosity are the two major, recurring, composite part producibility problems experienced by materials manufacturers today. The present invention holds substantial importance in reducing manufacturing costs of structural composite parts. Fabrication shops and their subcontractors worldwide experience repeated problems with part rejections and scrappage due to composite prepreg and woven material's extreme susceptibility to core crush and porosity. Utilization of the present invention, with essentially minimum additional cost, drastically reduces these two producibility problems, thus reducing part rejections and scrappage to achieve overall reduction in manufacturing costs related with structural composite parts.

The present invention has been described in relation to several preferred embodiments. One of ordinary skill after reading the foregoing specifications, may be able to effect various other changes, alterations, and substitutions or equivalents without departing from the broad concepts disclosed. Also, although the foregoing description does indicate that the present invention is particularly advantageous in the production of aircraft structured components, the present invention can be used to produce components for other vehicles or structures. It is therefore intended that the scope of the letters patent granted hereon be limited only by the definitions contained in the appended claims and the equivalents thereof The embodiments of the invention in which an exclusive property or privilege is claimed are defined as follows:

1. A composite prepreg material, comprising:

(a) warp yarns and fill yarns that include at least two different kinds of yarn selected from the group consisting of standard twist fiber, untwisted fiber, and never twisted fiber, wherein a first percentage of the warp yarns comprise one of the group consisting of standard twist fiber, untwisted fiber, and never twisted fiber, and wherein a second percentage of the warp yarns comprise a different one of the group consisting of standard twist fiber, untwisted fiber, and never twisted fiber; and (b) said warp yarns and said fill yarns being impregnated with a viscous resin.

2. The composite prepreg material of claim 1, wherein a first percentage of the warp yarns comprise one of the group consisting of standard twist fiber and never twisted fiber, and a second percentage of the warp yarns comprise the other of the group consisting of standard twist fiber and never twisted fiber.

3. The composite prepreg material of claim 1, wherein a first percentage of the warp yarns comprise one of the group consisting of standard twist fiber and untwisted fiber, and a second percentage of the warp yarns comprise the other of the group consisting of standard twist fiber and untwisted fiber.

4. The composite prepreg material of claim 1, wherein a first percentage of the warp yarns comprise one of the group consisting of untwisted fiber and never twisted fiber, and a second percentage of the warp yarns comprise the other of the group consisting of untwisted fiber and never twisted fiber.

5. The composite prepreg material of claim 1, wherein a first percentage of the fill yarns comprise one of the group consisting of standard twist fiber, untwisted fiber, and never twisted fiber, and wherein a second percentage of the fill yarns comprise a different one of the group consisting of standard twist fiber, untwisted fiber, and never twisted fiber.

6. The composite prepreg material of claim 5, wherein a first percentage of the fill yarns comprise one of the group consisting of standard twist fiber and never twisted fiber, and a second percentage of the fill yarns comprise the other of the group consisting of standard twist fiber and never twisted fiber.

7. The composite prepreg material of claim 5, wherein a first percentage of the fill yarns comprise one of the group consisting of untwisted fiber and never twisted fiber, and a second percentage of the fill yarns comprise the other of the group consisting of untwisted fiber and never twisted fiber.

8. The composite prepreg material of claim 5, wherein a first percentage of the fill yarns comprise one of the group consisting of standard twist fiber and untwisted fiber, and a second percentage of the fill yarns comprise the other of the group consisting of standard twist fiber and untwisted fiber.

9. A composite prepreg material, comprising:

(a) warp yarns and fill yarns that include at least two different kinds of yarn selected from the group consisting of standard twist fiber, untwisted fiber, and never twisted fiber wherein a first percentage of the warp yarns comprise one of the group consisting of standard twist fiber, untwisted fiber, and never twisted fiber, and wherein a second percentage of the warp yarns comprise a different one of the group consisting of standard twist fiber, untwisted fiber, and never twisted fiber, and wherein a third percentage of the warp yarns comprise a remaining one of the group consisting of standard twist fiber, untwisted fiber, and never twisted fiber; and (b) said warp yarns and said fill yarns being impregnated with a viscous resin.

10. A composite prepreg material, comprising:

(a) warp yarns and fill yarns that include at least two different kinds of yarn selected from the group consisting of standard twist fiber, untwisted fiber, and never twisted fiber, wherein a first percentage of the fill yarns comprise one of the group consisting of standard twist fiber, untwisted fiber, and never twisted fiber, and wherein a second percentage of the fill yarns comprise a different one of the group consisting of standard twist fiber, untwisted fiber, and never twisted fiber, and wherein a third percentage of the fill yarns comprise a remaining one of the group consisting of standard twist fiber, untwisted fiber, and never twisted fiber; and (b) said warp yarns and said fill yarns being impregnated with a viscous resin.

11. A woven composite prepreg material, comprising:

(a) multi-directional fibers having at least first and second directional configurations of interlaced material that include at least two different kinds of yarn selected from the group consisting of standard twist fiber, untwisted fiber, and never twisted fiber, wherein a first percentage of the first directional configuration of interlaced material comprises one of the group consisting of standard twist fiber, untwisted fiber, and never twisted fiber, and wherein a second percentage of the first directional configuration of interlaced material comprises a different one of the group consisting of standard twist fiber, untwisted fiber, and never twisted fiber;

(b) whereby the combination of at least two different kinds of yarn selected from the group facilitates reducing the frequency of porosity and core crush defects; and (c) said multi-directional fibers being impregnated with a viscous resin.

12. A woven composite prepreg material, comprising:

(a) multi-directional fibers having at least first and second directional configurations of interlaced material that include at least two different kinds of yarn selected from the group consisting of standard twist fiber, untwisted fiber, and never twisted fiber, wherein a first percentage of the second directional configuration of interlaced material comprises one of the group consisting of standard twist fiber, untwisted fiber, and never twisted fiber, and wherein a second percentage of the second directional configuration of interlaced material comprises a different one of the group consisting of standard twist fiber, untwisted fiber, and never twisted fiber;

(b) whereby the combination of at least two different kinds of yarn selected from the group facilitates reducing the frequency of porosity and core crush defects; and (c) said multi-directional fibers being impregnated with a viscous resin.

13. A woven composite prepreg material, comprising:

(a) multi-directional fibers having at least first and second directional configurations of interlaced material that include at least two different kinds of yarn selected from the group consisting of standard twist fiber, untwisted fiber, and never twisted fiber, wherein a first percentage of the first directional configuration of interlaced material comprises one of the group consisting of standard twist fiber, untwisted fiber, and never twisted fiber, and wherein a second percentage of the first directional configuration of interlaced material comprises a different one of the group consisting of standard twist fiber, untwisted fiber, and never twisted fiber, and wherein a third percentage of the first directional configuration of interlaced material comprises a remaining one of the group consisting of standard twist fiber, untwisted fiber, and never twisted fiber;

(b) whereby the combination of at least two different kinds of yarn selected from the group facilitates reducing the frequency of porosity and core crush defects; and (c) said multi-directional fibers being impregnated with a viscous resin.

14. A woven composite prepreg material, comprising:

(a) multi-directional fibers having at least first and second directional configurations of interlaced material that include at least two different kinds of yarn selected from the group consisting of standard twist fiber, untwisted fiber, and never twisted fiber, wherein a first percentage of the second directional configuration of interlaced material comprises one of the group consisting of standard twist fiber, untwisted fiber, and never twisted fiber, and wherein a second percentage of the second directional configuration of interlaced material comprises a different one of the group consisting of standard twist fiber, untwisted fiber, and never twisted fiber, and wherein a third percentage of the second directional configuration of interlaced material comprises a remaining one of the group consisting of standard twist fiber, untwisted fiber, and never twisted fiber;

(b) whereby the combination of at least two different kinds of yarn selected from the group facilitates reducing the frequency of porosity and core crush defects; and (c) said multi-directional fibers being impregnated with a viscous resin.

* * * * *